US012590542B2

(12) United States Patent
Li et al.

(10) Patent No.: US 12,590,542 B2
(45) Date of Patent: Mar. 31, 2026

(54) METHOD FOR DETECTING STRESS STATE OF ROADWAY SURROUNDING ROCKS BASED ON THREE-DIMENSIONAL ELECTRIC POTENTIAL RESPONSE

(71) Applicant: China University of Mining and Technology, Xuzhou City (CN)

(72) Inventors: Zhonghui Li, Xuzhou City (CN); Tiancheng Shan, Xuzhou City (CN); Xiaoran Wang, Xuzhou City (CN); Yue Niu, Xuzhou City (CN); Xin Zhang, Xuzhou City (CN); Chaolin Zhang, Xuzhou City (CN); Dong Chen, Xuzhou City (CN); Chao Cai, Xuzhou City (CN); Shan Yin, Xuzhou City (CN)

(73) Assignee: China University of Mining and Technology, Xuzhou (CN)

( * ) Notice: Subject to any disclaimer, the term of this patent is extended or adjusted under 35 U.S.C. 154(b) by 285 days.

(21) Appl. No.: 18/563,380

(22) PCT Filed: Oct. 12, 2023

(86) PCT No.: PCT/CN2023/124177
§ 371 (c)(1),
(2) Date: Nov. 22, 2023

(87) PCT Pub. No.: WO2024/046501
PCT Pub. Date: Mar. 7, 2024

(65) Prior Publication Data

US 2025/0277451 A1 Sep. 4, 2025

(30) Foreign Application Priority Data

Nov. 28, 2022 (CN) ..... 202211499444.5

(51) Int. Cl.
*E21F 17/18* (2006.01)

(52) U.S. Cl.
CPC ..... *E21F 17/18* (2013.01)

(58) Field of Classification Search
None
See application file for complete search history.

(56) References Cited

U.S. PATENT DOCUMENTS 8,548,782 B2 * 10/2013 Hsu ..... G01V 11/00 166/250.03
9,194,968 B2 * 11/2015 Imhof ..... G01V 1/302
(Continued)

*Primary Examiner* — Mark A Shabman

(57) ABSTRACT

A method for detecting a stress state-of rocks surrounding a roadway based on three-dimensional electric potential response is disclosed. By collecting electric potential data, and performing spatial interpolation on all the electric potential measurement points to obtain a three-dimensional electric potential imaging volume, three-dimensional electric potentials can be used to draw electric potential isosurface models. By using a radial basis function surface interpolation method to draw a three-dimensional abnormal electric potential inversion probability isosurface model, it is possible to intuitively visualize electric potential distribution spatial characteristics of rocks surrounding a roadway, so as to clearly display a spatial range, direction and development trend of abnormal stress zones, and accurately identify and determine the stress states of roadway rock formations.

5 Claims, 5 Drawing Sheets

(56) References Cited

U.S. PATENT DOCUMENTS

| | | | | |
|---|---|---|---|---|
| 12,106,434 | B2 * | 10/2024 | Wang | G06N 3/0464 |
| 2004/0172199 | A1 * | 9/2004 | Chavarria | G01V 11/00 702/14 |
| 2005/0063593 | A1 * | 3/2005 | Nelson | G06V 10/255 382/190 |
| 2009/0070042 | A1 * | 3/2009 | Birchwood | G01V 1/50 702/11 |
| 2012/0029895 | A1 * | 2/2012 | Xi | G01V 20/00 703/10 |
| 2023/0046926 | A1 * | 2/2023 | Saxena | G06T 17/05 |
| 2024/0378337 | A1 * | 11/2024 | Yang | G06T 17/05 |
| 2025/0284854 | A1 * | 9/2025 | Xu | G06F 30/13 |

* cited by examiner

METHOD FOR DETECTING STRESS STATE OF ROADWAY SURROUNDING ROCKS BASED ON THREE-DIMENSIONAL ELECTRIC POTENTIAL RESPONSE

CROSS-REFERENCE TO RELATED APPLICATION

This application is a Section 371 National Stage Application of International Application No. PCT/CN2023/124177, filed on Oct. 12, 2023, entitled "Method for Detecting Stress State of Roadway Surrounding Rocks Based on Three-Dimensional Electric Potential Response", which claims priority to Chinese Application No. 202211499444.5, filed on Nov. 28, 2022, incorporated herein by reference in their entirety.

TECHNICAL FIELD

The present disclosure relates to the field of stability of roadway surrounding rocks, and in particular to a method for detecting stress state of roadway surrounding rocks based on three-dimensional electric potential response.

BACKGROUND

In the process of coal mining and underground engineering facility construction, the stability during roadway excavation and production practice is crucial to normal production and life. However, the deformation and instability of rock mass that often happen can induce rock bursts (impact ground pressure), rockbursts, mine earthquakes or other serious constructive geological disasters. These disasters are essentially destructive fractures of coal and rock mass caused by stress concentration. Identifying dangerous stress states timely and effectively before the disasters happening so as to take preventive measures early is the focus in the field of rock mechanics, and geophysical methods are effective way for disaster prediction. On the other hand, the surrounding rocks of the roadway (tunnel) are in a complex and uneven pressure-bearing state due to engineering construction disturbances, and the development and expansion of internal cracks cannot be determined. How to clearly and accurately obtain the distribution area and influence scope of different stress states in the surrounding rocks of the roadway and visually display them helps provide strong support for the prevention and control of coal and rock dynamic disasters. Therefore, accurate measurement of the stress state of surrounding rocks in coal and rock tunnels (roadways) has important practical engineering significance for in-depth understanding of rock catastrophic evolution, damage and fracture process, and early prediction of disaster occurrences, thereby avoiding casualties and property losses.

At present, the main monitoring methods for the stress state and damage characteristics of roadway surrounding rocks include in-hole imaging monitoring, monitoring by displacement monitor, acoustic emission positioning monitoring and wave velocity imaging monitoring. However, these traditional monitoring methods still have their own limitations, and new monitoring methods are needed to supplement and replace the research on damage and failure (destruction) characteristics of roadway surrounding rocks. Research shows that rock deformation and cracking will trigger generation and migration of charges, thereby generating surface electric potentials at different locations of the rocks. The surface electric potential signals provide a solution for monitoring the damage and failure characteristics of the roadway surrounding rocks. Surface electric potential is a reliable and common geophysical exploration method. Many studies have applied surface electric potentials in fire detection, water inrush prediction and permeability measurement. For example, Chinese patent CN114088782B disclosed an electric potential identification method for water inrush dangerous area of coal and rock mass under the action of stress and seepage, Chinese patent CN110989018A and patent CN111123365B respectively disclosed a fire location detection system and detection method for goaf areas based on a natural electric potential method, and a delayed water inrush early warning system and its usage method for goaf areas, Chinese patent CN112799140A disclosed a permeability estimation method based on natural electric potential inversion. These technical methods are still limited to arranging grid electrode arrays, analyzing time series characteristics, and using two-dimensional surface nephograms and inversion tomogram nephograms (cloud images). And it is easy for them to miss key information, difficult to accurately locate the location of danger sources, impossible to grasp the development trend of hidden dangers globally. Meanwhile, it is rarely possible to analyze the electric potential characteristics of three-dimensional space.

SUMMARY

In order to solve the problem that existing technologies rarely realize the analysis of three-dimensional spatial electric potential characteristics, the present disclosure provides a method for detecting stress states of roadway surrounding rocks based on three-dimensional electric potential response. In order to achieve the above technical objectives, the present disclosure adopts the following technical solutions:

A method for detecting stress state of roadway surrounding rocks based on three-dimensional electric potential response, comprising:

S1: using a roadway space with a length of S along a roadway direction from an front end of a mining face as a detection area, selecting several roadway construction sections in the detection area, drilling boreholes in roadway surrounding rocks along different direction towards a roof, two roadway side walls, and a floor in each roadway construction section, wherein at least two boreholes are drilled for each direction;

S2: obtaining an electric potential measurement surface through similar amplification of a roadway contour around the roadway by a similar amplification proportion coefficient $\delta_i$, using intersection lines of the electric potential measurement surface and the roadway construction sections as electric potential measurement lines, determining a distance $L_i$ between the i-th electric potential measurement line and the roadway contour, disposing positive electrodes at intersection positions of the boreholes and the electric potential measurement lines, and using positions of the positive electrodes as electric potential measurement points;

S3: disposing a common negative electrode in the roadway away from the positive electrodes, collecting electric potential data in real time, that is, electrical potential differences between various positive electrodes and the common negative electrode, and storing the electric potential data and three-dimensional coordinates of the electric potential measurement points in the boreholes and roadway surrounding geological information in an analysis computer;

S4: flattening the roadway contour to expand into a plane along a side line of the roadway in the roadway direction, expanding the electric potential measurement lines into horizontal lines arranged in sequence from low to high, scaling down the roadway contour into a digital model according to an equal proportion principle, and positioning position coordinates of the boreholes and the electric potential measurement points on the model;

S5: performing spatial interpolation on all the electric potential measurement points to obtain a three-dimensional electric potential imaging volume, extracting three-dimensional abnormal electric potentials from the three-dimensional electric potential imaging volume, and drawing a three-dimensional abnormal electric potential isosurface model;

S6: performing unilateral inversion outside a borehole area through the electric potential measurement points on the electric potential measurement line at the highest position, to obtain an electric potential inversion plane nephogram, which divides a space outside the boreholes into several cuboid spaces, using a radial basis function surface interpolation method to draw a three-dimensional abnormal electric potential inversion probability isosurface model;

S7: using a three-dimensional electric potential response digital model, which is composed of the three-dimensional abnormal electric potential isosurface model and the three-dimensional abnormal electric potential inversion probability isosurface model, to intuitively visualize electric potential distribution spatial characteristics of the roadway surrounding rocks and clearly display a spatial range, direction and development trend of a stress abnormal zone, and identifying and determining a stress state of the roadway and an abnormal electric potential response area.

Compared with the conventional technology, the beneficial effects of the present disclosure are:

I. The present disclosure displays the stress state of the surrounding rock of the roadway through a three-dimensional electric potential response digital model, and proposes a method of flattening the roadway contour to expand into a plane and constructing a visual model in the space above it, it improves the analysis efficiency and accuracy of electric potential data and facilitates analyzing spatial electric potential changes from a global perspective to avoid problems of incoherence and large errors in local analysis.

II. The present disclosure proposes to use the trilinear nearest point interpolation method and the Marching Cubes algorithm to obtain three dimensional electric potential imaging isosurface nephograms (cloud images), and use unilateral inversion tomogram imaging and radial basis function surface interpolation method to obtain abnormal electric potential inversion probability isosurface nephograms, dynamically visualize the electric potential spatial evolution characteristics of the surrounding rock area of the roadway, effectively making up for the shortcomings of traditional electric potential monitoring such as strong local interference, inability to accurately locate hidden dangers, and difficulty in judging the development trend of hidden dangers. The monitoring accuracy is high, the display is clear and intuitive, and the results are reliable.

BRIEF DESCRIPTION OF THE DRAWINGS

In order to explain the embodiments of the present disclosure or the technical solutions of the prior art more clearly, the following will briefly introduce the drawings needed to describe the embodiments or the prior art. Obviously, the drawings in the following description are only for some embodiments of the present disclosure, those of ordinary skill in the art can also obtain other drawings based on these drawings without exerting creative efforts.

Figure 1:
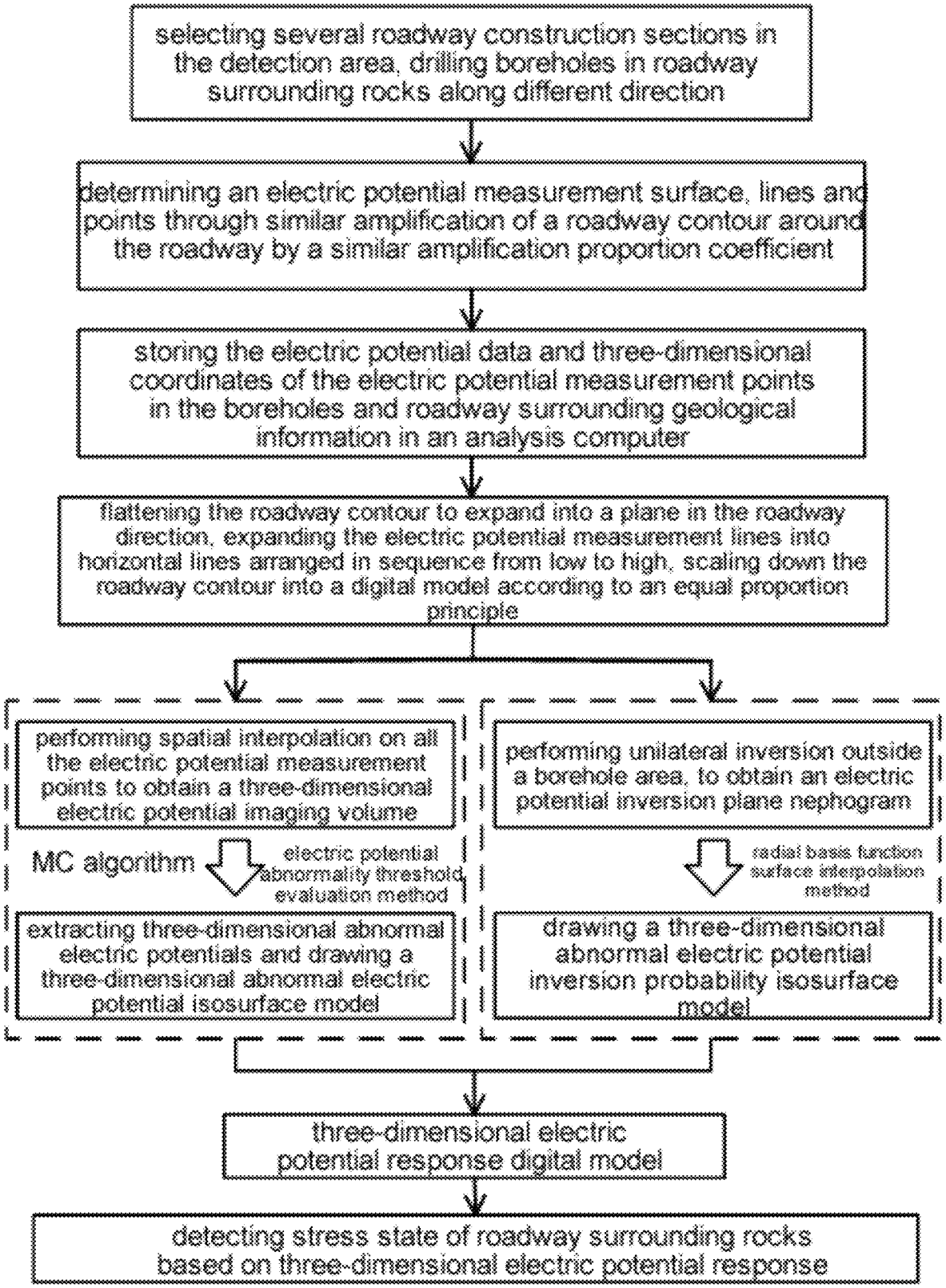
FIG. 1 is a flow chart of the method of the present disclosure.

In the drawings: 1—roadway/tunnel, 2—borehole, 3—first roadway construction section, 4—second roadway construction section, 5—electric potential measurement line, 6—electric potential measurement point, 7—plane, 8—cuboid grid, 9—electric potential inversion plane nephogram.

DETAILED DESCRIPTION OF EMBODIMENTS

The technical solutions in the embodiments of the present disclosure will be clearly and completely described below with reference to the accompanying drawings in the embodiments of the present disclosure. Obviously, the described embodiments are only some representative embodiments of the present disclosure, rather than all the embodiments. Based on the embodiments of the present disclosure, all other embodiments obtained by those of ordinary skill in the art without creative efforts fall within the scope of protection of the present disclosure.

Example

Figure 2:
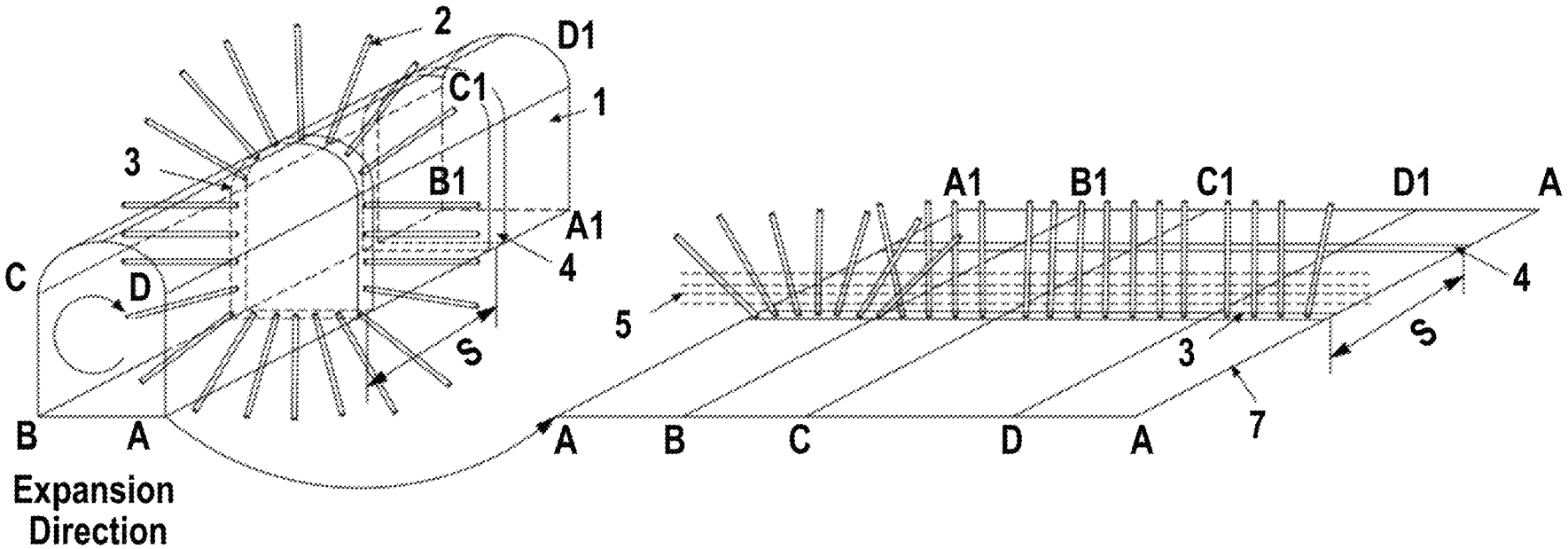
FIG. 2 is a schematic view of a roadway contour and a space visualization model after the roadway contour is flattened into a plane according to the present disclosure.

A method for detecting stress state of roadway surrounding rocks based on three-dimensional electric potential response, including the following steps:

S1: as shown in FIG. 2, using a roadway space with a length of S along a direction of a roadway 1 from an front end of a mining face as a detection area, selecting two roadway construction sections in the detection area, a first roadway construction section 3 located at the most front of the detection area and a second roadway construction section 4 located at the most end of the detection area, drilling boreholes 2 in roadway surrounding rocks along different direction towards a roof, two roadway side walls, and a floor in each roadway construction section, wherein at least two boreholes 2 are drilled for each direction. In order to show it more clearly in FIG. 1, only the boreholes of one roadway construction section is shown.

Figure 3:
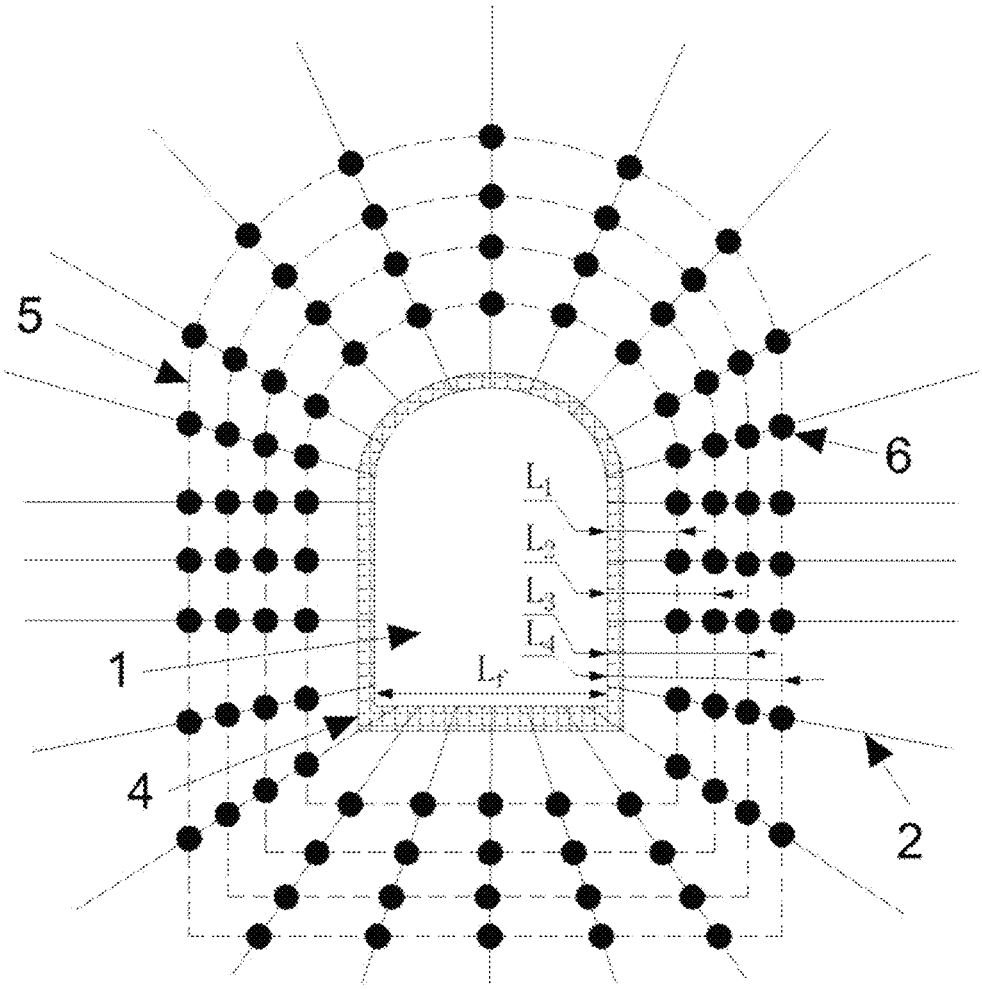
FIG. 3 is a schematic cross-sectional view showing the arrangement and positioning position of borehole electrodes according to the present disclosure.

S2: as shown in FIG. 3, obtaining an electric potential measurement surface through similar amplification of a roadway contour around the roadway 1 by a similar amplification proportion coefficient $\delta_i$, using intersection lines of the electric potential measurement surface intersecting with the roadway construction sections as electric potential measurement lines 5. determining a distance $L_i$ between the i-th electric potential measurement line and the roadway contour, disposing positive electrodes at intersection positions of the boreholes intersecting with the electric potential measurement lines, and using positions of the positive electrodes as electric potential measurement points 6.

The distance $L_i$ between the i-th electric potential measurement line 5 and the roadway contour is calculated as follows:

$$L_i = \frac{(\delta_i - 1) * L_f}{2} \quad i = 1, 2, 3, \ldots, n$$

where $L_f$ is a length of a bottom edge of the roadway, n is the number of electric potential measurement lines, $\delta_i$ is the similar amplification proportion coefficient of the i-th electric potential measurement line, and $\delta_i > 1$.

S3: disposing a common negative electrode in the roadway away from the positive electrodes, collecting electric potential data in real time, that is, electric potential differences between various positive electrodes and the common negative electrode, and storing the electric potential data and three-dimensional coordinates of the electric potential measurement points in the boreholes and roadway surrounding geological information in an analysis computer.

S4: as shown in FIG. 2, flattening the roadway contour to expand into a plane 7 along a side line AA1 of the roadway in the roadway direction, expanding the electric potential measurement lines 5 into horizontal lines arranged in sequence from low to high, scaling down the roadway contour into a digital model according to an equal proportion principle; using the plane into where the roadway contour is expanded as a base (the equal-proportion digital model of the roadway use the plane as a base), drawing the electric potential measurement points 7 in the boreholes of the roadway above the plane 7 according to spatial three-dimensional coordinates on the electric potential measurement lines, forming a spatial three-dimensional visualization model, and positioning position coordinates of the boreholes 2 and the electric potential measurement points 6 on the model.

Figure 4:
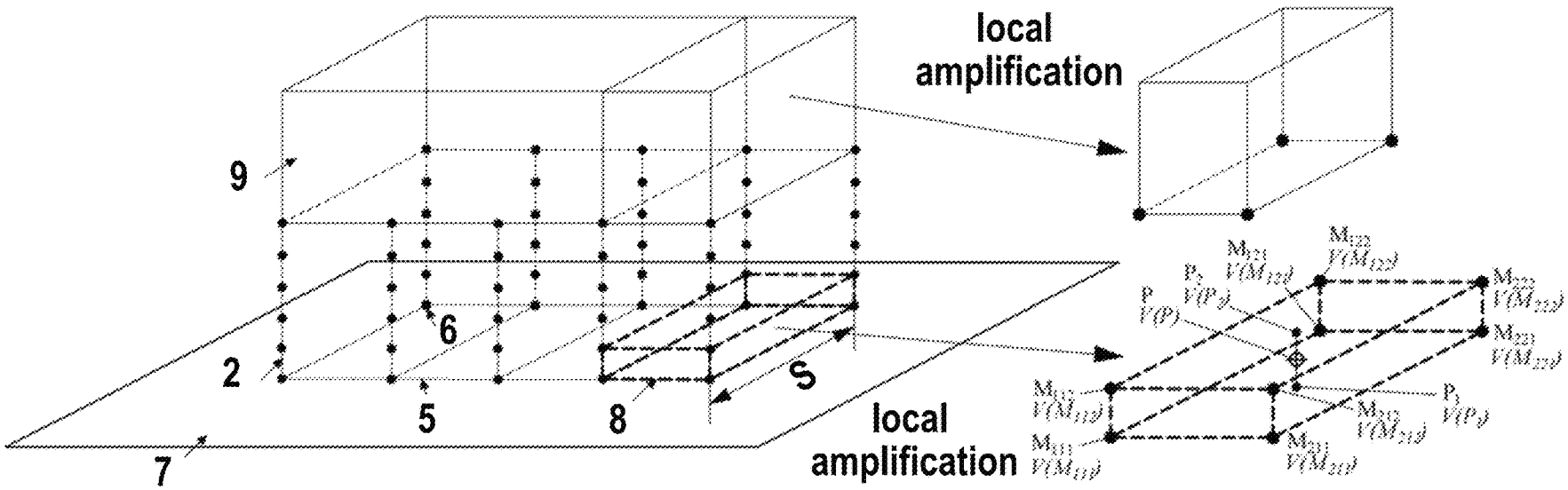
FIG. 4 is a schematic view of a cuboid grid using trilinear nearest point interpolation and radial basis function surface interpolation according to the present disclosure.

S5: performing spatial interpolation on all the electric potential measurement points 6 to obtain a three-dimensional electric potential imaging volume, extracting three-dimensional abnormal electric potentials from the three-dimensional electric potential imaging volume and drawing a three-dimensional abnormal electric potential isosurface model; the steps are as follows:

S51: performing spatial interpolation on all the electric potential measurement points to obtain the three-dimensional electric potential imaging volume by using a trilinear nearest point interpolation method, including:

S511: as shown in FIG. 4, using the electric potential measurement points 6 in space as vertices, dividing the entire detection area into several cuboid grids composed of 8 nearest vertices, setting an interpolation density 2, using a three-dimensional grid search near any one interpolation point, and finding the cuboid grid where the interpolation point is located;

S512: for a certain interpolation point P, its coordinates are (x, y, z), electric potential value is V(P), coordinates of the vertex $M_{ijk}$ of the cuboid are ($x_i$, $y_j$, $z_k$), and i, j, k are 1 or 2, electric potential value of the vertex $M_{ijk}$ of the cuboid is $V(M_{ijk})$; electric potential value $V(P_1)$ of the interpolation point P at a projection point $P_1$ in a plane $M_{111}M_{121}M_{221}M_{211}$ has the following calculation formula:

$$V(P_1) = \frac{(x_2 - x)(y_2 - y)}{(x_2 - x_1)(y_2 - y_1)} V(M_{111}) + \frac{(x - x_1)(y_2 - y)}{(x_2 - x_1)(y_2 - y_1)} V(M_{211}) + \frac{(x_2 - x)(y - y_1)}{(x_2 - x_1)(y_2 - y_1)} V(M_{121}) + \frac{(x - x_1)(y - y_1)}{(x - x_1)(y_2 - y_1)} V(M_{221})$$

electric potential value $V(P_2)$ of the interpolation point P at a projection point $P_2$ in a plane $M_{112}M_{122}M_{222}M_{212}$ has the following calculation formula:

$$V(P_2) = \frac{(x_2 - x)(y_2 - y)}{(x_2 - x_1)(y_2 - y_1)} V(M_{112}) + \frac{(x - x_1)(y_2 - y)}{(x_2 - x_1)(y_2 - y_1)} V(M_{212}) + \frac{(x_2 - x)(y - y_1)}{(x_2 - x_1)(y_2 - y_1)} V(M_{122}) + \frac{(x - x_1)(y - y_1)}{(x - x_1)(y_2 - y_1)} V(M_{222})$$

then a calculation formula of an electric potential value V(P) at the Interpolation point P is:

$$V(P) = \frac{z_2 - z}{z_2 - z_1} V(M_{P_1}) + \frac{z - z_1}{z_2 - z_1} V(M_{P_2})$$

Figure 5:
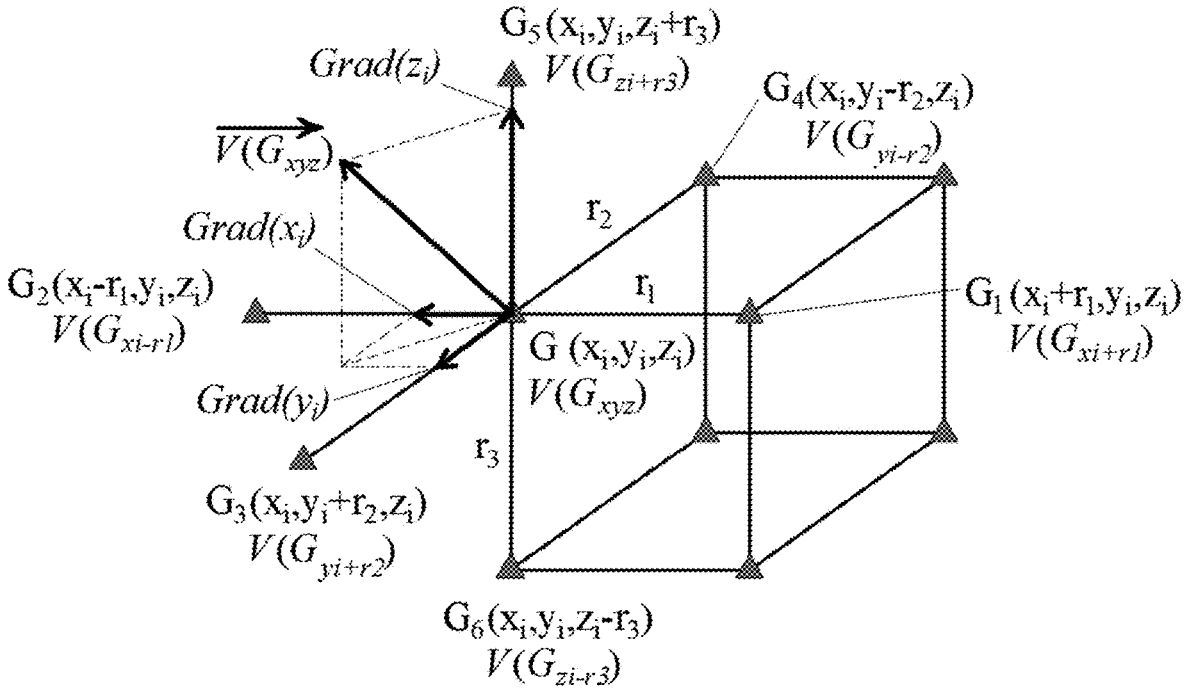
FIG. 5 is a schematic view of a cuboid unit using MC algorithm process in the embodiments of the present disclosure.

S52: extracting three-dimensional abnormal electric potentials from the three-dimensional electric potential imaging volume:

using an electric potential abnormality threshold evaluation method to determine whether the electric potential value V(P) of a certain point is a possible dangerous electric potential value: first, set an electric potential abnormality threshold (based on historical data and laboratory tests, if $V(P) \geq \zeta$, then the point is determined to be an abnormal electric potential point, that is, the roadway surrounding rock at this point has a risk of abnormal stress state and unstable deformation; if not, there is no risk of abnormal stress state and unstable deformation;

S53: using Marching Cubes (MC) algorithm to extract an electric potential isosurface, comprising:

S531: according to the interpolation density λ, extracting coordinates and electric potential values of the cuboid unit and its vertices in the three-dimensional electric potential imaging volume, wherein length $r_1$, width $r_2$, and height $r_3$ of the cuboid unit meet the following condition:

$$\begin{cases} r_1 r_2 r_3 = \frac{1}{\lambda} = \frac{(x_2 - x_1)(y_2 - y_1)(z_2 - z_1)}{m_1 m_2 m_3} \\ r_1 = \frac{x_2 - x_1}{m_1} \\ r_2 = \frac{y_2 - y_1}{m_2} \\ r_3 = \frac{z_2 - z_1}{m_3} \end{cases} \quad m_1, m_2, m_3 = 1, 2, 3, \ldots, 100$$

where, $m_1$, $m_2$, $m_3$ are scale factors in length, width, and height directions of the cuboid unit respectively;

S532: comparing the electric potential value $U_q$(q=1~8) of each vertex of the cuboid unit with the electric potential value V of the isosurface; if $U_q < V$, then set an index value $I_q$ of the vertex to 0; if $U_q \geq V$, then set the index value $I_q$ of the vertex to 1; if the index values of two vertices on any one edge of the cuboid unit are 0 and 1 respectively, it means that the isosurface must pass through this edge and have an intersection point; writing down state table index of the cuboid unit, Index={$I_1$, $I_2$, $I_3$, $I_4$, $I_5$, $I_6$, $I_7$, $I_8$}, and getting to know which edges of the cuboid unit intersect with the isosurface based on the state table index, thus obtaining intersection points of the edges of the cuboid unit intersecting with the isosurface, coordinates of the intersection points, and intersection surface information composed of the intersection points through a linear interpolation method;

S533: as shown in FIG. 5, using a central difference theory to calculate gradient values of various vertices of the cuboid unit in different directions, and then determining their normal vector values $\overrightarrow{V(G_{xyz})}$, a calculation formula for the gradient values of a vertex G of the cuboid unit in different directions is:

$$\begin{cases} Grad(x_i) = \dfrac{V(G_{x_i+r_1}) - V(G_{x_i-r_1})}{2r_1} \\ Grad(y_i) = \dfrac{V(G_{y_i+r_2}) - V(G_{y_i-r_2})}{2r_2} \\ Grad(z_i) = \dfrac{V(G_{z_i+r_3}) - V(G_{z_i-r_3})}{2r_3} \end{cases}$$

where, $V(G_{x_i+r_1})$ and $V(G_{x_i-r_1})$ are respectively the electric potential values of vertex G at adjacent interpolation points on an x-axis, and $V(G_{y_i+r_2})$ and $V(G_{y_i-r_2})$ are respectively the electric potential values of vertex G at adjacent interpolation points on a y-axis, $V(G_{z_i+r_3})$ and $V(G_{z_i+r_3})$ are respectively the electric potential values of vertex G at adjacent interpolation points on a z-axis, the normal vector value $\overrightarrow{V(G_{xyz})}$ at the vertex G is a vector sum of Grad($x_i$), Grad($y_i$) and Grad($z_i$);

S534: using a linear interpolation method to process the normal vectors of the vertices of the cuboid unit to calculate the normal vectors of the intersection points of the edges of the cuboid unit intersecting with the isosurface, and determining a spatial shape of the electric potential isosurface according to the coordinates and the normal vectors of the intersection points of the edges of the cuboid unit intersecting with the isosurface.

S6: performing unilateral inversion outside a borehole area through the electric potential measurement points on the electric potential measurement line at the highest position, to obtain an electric potential inversion plane nephogram 9, which divides a space outside the boreholes into several cuboid spaces, using a radial basis function surface interpolation method to draw a three-dimensional abnormal electric potential inversion probability isosurface model.

The step S6 comprises: performing unilateral inversion outside a borehole area through the electric potential measurement points on the electric potential measurement line at the highest position, to obtain an electric potential inversion plane nephogram 9, which divides a space outside the boreholes into several cuboid spaces, using a radial basis function surface interpolation method to perform interpolation on an interior of a cuboid grid, obtaining a three-dimensional isosurface model of electric potential inversion probability value by splicing and merging, the specific calculation method is as follows:

S61: performing unilateral inversion outside the borehole area through the electric potential measurement points on the electric potential measurement line at the highest position, to obtain electric potential inversion probability values of various points on the electric potential inversion plane nephogram, which represents a probability of abnormal electric potentials, with a value range between 0 and 1, and the larger the value is, the higher a degree of danger is; dividing an outer ring space of the borehole into several cuboid grids through the electric potential inversion plane nephogram, selecting a certain cuboid grid, whose length, width and height are $(x_2-x_1)$, $(y_2-y_1)$, $(z_3-z_2)$ respectively, and selecting a total of m scattered points with the same electric potential inversion probability value $\eta$ from 6 facets of the cuboid grid, wherein the electric potential inversion probability value is $T_i$, $T_i=\eta$, and its coordinate vector is $R_r=(x_r, y_r, z_r)$;

S62: constructing a matrix vector $T=(T_1, T_2, T_3, \ldots, T_m, 0, 0, 0, 0)$ of the electric potential inversion probability values of various scattered points, the used Gaussian radial basis function $u(R-R_r)$ has an expression of:

$$u(R-R_r) = e^{\left(-\frac{\|R-R_r\|^2}{2\sigma_r^2}\right)} \quad r = 1, 2, 3, \ldots, m$$

where, $$\sigma_r = \frac{\mathrm{Max}\|R_i - R_j\|}{\sqrt{2m}},$$

i, j=1, 2, 3, . . . , m, R=(x, y, z) is a coordinate vector of an interpolation point inside the cuboid grid, $R_i=(x_i, y_i, z_i)$, $R_j=(x_j, y_j, z_j)$ are respectively coordinate vectors of points i and j on the facets of the cuboid grid, $\mathrm{Max}\|R_i-R_j\|$ is the farthest distance between scattered points;

S63: obtaining an unknown parameter vector E by solving the following matrix formula using a least square method:

$$U \cdot E = T$$

wherein, vector $E=(e_1, e_2, e_3, \ldots, e_m, c_0, c_1, c_2, c_3)$, $e_i$ is an unknown parameter, $$U = \begin{bmatrix} u_{11} & u_{12} & \ldots & u_{1m} & 1 & x_1 & y_1 & z_1 \\ u_{21} & u_{22} & \ldots & u_{2m} & 1 & x_2 & y_2 & z_2 \\ \vdots & \vdots & \vdots & \vdots & \vdots & \vdots & \vdots & \vdots \\ u_{m1} & u_{m2} & \ldots & u_{mm} & 1 & x_m & y_m & z_m \\ 1 & 1 & \ldots & 1 & 1 & x_m & y_m & z_m \\ x_1 & x_2 & \ldots & x_m & 0 & 0 & 0 & 0 \\ y_1 & y_2 & \ldots & y_m & 0 & 0 & 0 & 0 \\ z_1 & z_2 & \ldots & z_m & 0 & 0 & 0 & 0 \end{bmatrix}, \; u_{ij} = u(\|R_i - R_j\|), \text{ and } i,$$

$$j = 1, 2, 3, \ldots, m;$$

S64: substituting the unknown parameter in the solved unknown parameter vector E into the following formula, constructing a constraint condition $$\begin{cases} x_1 < x < x_2 \\ y_1 < y < y_2 \\ z_2 < z < z_3 \end{cases},$$

to calculate the coordinate vector R=(x, y, z) of all interpolation points inside the cuboid grid:

$$T(R) = \sum_{i=1}^{m} e_i u(\|R - R_i\|) + c_0 + c_1 x + c_2 y + c_3 z$$

wherein, T(R) is the electric potential inversion probability value at the interpolation point on the isosurface, and T(R)=η.

S65: obtaining the isosurface in each cuboid grid, connecting the isosurfaces inside all cuboid grids according to a shared relationship between facets and edges, to obtain the isosurface model when the electric potential inversion probability value is η.

S7: using a three-dimensional electric potential response digital model, which is composed of the three-dimensional abnormal electric potential isosurface model and the three-dimensional abnormal electric potential inversion probability isosurface model, to intuitively visualize electric potential distribution spatial characteristics of the roadway surrounding rocks and clearly display a spatial range, direction and development trend of a stress abnormal zone, and identifying and determining a stress state of the roadway and an abnormal electric potential response area.

What is claimed is:

1. A method for detecting stress state of roadway surrounding rocks based on three-dimensional electric potential response, comprising steps of:

S1: using a roadway space with a length of S along a roadway direction from an front end of a mining face as a detection area, selecting several roadway construction sections in the detection area, drilling boreholes in roadway surrounding rocks into a roof, two roadway side walls, and a floor in each roadway construction section, wherein at least two boreholes are drilled in each of said roof, two roadway side walls and floor;

S2: obtaining an electric potential measurement surface through amplification of a roadway contour electric potential measurement around the roadway by a proportionality coefficient $\delta_i$, using intersection lines of the electric potential measurement surface and the roadway construction sections as electric potential measurement lines, determining a distance $L_i$ between the i-th electric potential measurement line and the roadway contour, disposing positive electrodes at intersection positions of the boreholes and the electric potential measurement lines, and using positions of the positive electrodes as electric potential measurement points;

S3: disposing a common negative electrode in the roadway, collecting electric potential data in real time comprising electric potential differences between the positive electrodes and the common negative electrode, and storing the electric potential data and three-dimensional coordinates of the electric potential measurement points in the boreholes and roadway surrounding geological information in an analysis computer;

S4: digitally flattening the roadway contour to expand into a plane along a side line of the roadway in the roadway direction, extrapolating the electric potential measurement lines into horizontal lines arranged in sequence from low to high, scaling down the roadway contour into a digital model according to an equal proportion principle, and positioning position coordinates of the boreholes and the electric potential measurement points on the model;

S5: performing spatial interpolation on all the electric potential measurement points to obtain a three-dimensional electric potential imaging volume, extracting three-dimensional abnormal electric potentials from the three-dimensional electric potential imaging volume and drawing a three-dimensional abnormal electric potential isosurface model wherein abnormal electric potentials are identified using an electric potential abnormality threshold evaluation method;

S6: performing unilateral inversion tomogram imaging outside a borehole area through the electric potential measurement points on the electric potential measurement line at the highest position, to obtain an electric potential inversion plane nephogram, which divides a space outside the boreholes into several cuboid spaces, and using a radial basis function surface interpolation method to draw a three-dimensional abnormal electric potential inversion probability isosurface model;

S7: visualizing electric potential distribution spatial characteristics of the roadway surrounding rocks using a three-dimensional electric potential response digital model, which is composed of the three-dimensional abnormal electric potential isosurface model and the three-dimensional abnormal electric potential inversion probability isosurface model, by displaying a spatial range, direction and development trend of a stress abnormal zone, thus allowing identification and determination of a stress state of the roadway and an abnormal electric potential response area.

2. The method of claim 1, where the distance $L_i$ between the i-th electric potential measurement line and the roadway contour in step S2 is calculated as follows:

$$L_i = \frac{(\delta_i - 1) * L_f}{2} \quad i = 1, 2, 3, \ldots, n$$

where $L_f$ is a length of a bottom edge of the roadway, n is the number of electric potential measurement lines, $\delta_i$ is the proportionality coefficient of the i-th electric potential measurement line, and $\delta_i > 1$.

3. The method of claim 1, wherein the step S4 further comprises: using the plane into where the roadway contour is expanded as a base, computationally drawing the electric potential measurement points in the boreholes of the roadway above the plane according to spatial three-dimensional coordinates on the electric potential measurement lines, and forming a spatial three-dimensional visualization model.

4. The method of claim 1, wherein the step S5 comprises:

S51: performing spatial interpolation on all the electric potential measurement points to obtain the three-dimensional electric potential imaging volume by using a trilinear nearest point interpolation method, comprising:

S511: using the electric potential measurement points in space as vertices, dividing the entire detection area into several cuboid grids composed of 8 nearest vertices, setting an interpolation density λ, using a three-dimensional grid search near any one interpolation point, and finding the cuboid grid where the interpolation point is located wherein the three-dimensional grid search is carried out as follows:

for a certain interpolation point P, with coordinates (x, y, z), electric potential value is V(P), coordinates of the vertex $M_{ijk}$ of the cuboid are ($x_i$, $y_j$, $z_k$), and i, j, k are 1 or 2, electric potential value of the vertex $M_{ijk}$ of the cuboid is $V(M_{ijk})$; electric potential value $V(P_1)$ of the interpolation point P at a projection point $P_1$ in a plane $M_{111}M_{121}M_{221}M_{211}$ has the following calculation formula:

$$V(P_1) = \frac{(x_2 - x)(y_2 - y)}{(x_2 - x_1)(y_2 - y_1)} V(M_{111}) + \frac{(x - x_1)(y_2 - y)}{(x_2 - x_1)(y_2 - y_1)} V(M_{211}) + \frac{(x_2 - x)(y - y_1)}{(x_2 - x_1)(y_2 - y_1)} V(M_{121}) + \frac{(x - x_1)(y - y_1)}{(x - x_1)(y_2 - y_1)} V(M_{221})$$

electric potential value $V(P_2)$ of the interpolation point P at a projection point $P_2$ in a plane $M_{112}M_{122}M_{222}M_{212}$ has the following calculation formula:

$$V(P_2) = \frac{(x_2 - x)(y_2 - y)}{(x_2 - x_1)(y_2 - y_1)} V(M_{112}) + \frac{(x - x_1)(y_2 - y)}{(x_2 - x_1)(y_2 - y_1)} V(M_{212}) + \frac{(x_2 - x)(y - y_1)}{(x_2 - x_1)(y_2 - y_1)} V(M_{122}) + \frac{(x - x_1)(y - y_1)}{(x - x_1)(y_2 - y_1)} V(M_{222})$$

then a calculation formula of an electric potential value V(P) at the interpolation point P is:

$$V(P) = \frac{z_2 - z}{z_2 - z_1} V(M_{P_1}) + \frac{z - z_1}{z_2 - z_1} V(M_{P_2})$$

S52: extracting three-dimensional abnormal electric potentials from the three-dimensional electric potential imaging volume wherein three-dimensional abnormal electric potentials are identified by using an electric potential abnormality threshold evaluation method to determine whether the electric potential value V(P) of a point is a possible dangerous electric potential value that exceeds an electric potential abnormality threshold ζ, wherein, if V(P)≥ζ, then the point is determined to be an abnormal electric potential point, wherein the roadway surrounding rock at an abnormal electric potential point has a risk of abnormal stress state and unstable deformation; and wherein, if the electric potential value V(P) does not exceed the electric potential abnormality threshold ζ, there is no risk of abnormal stress state and unstable deformation;

S53: using a marching cubes (MC) algorithm to extract an electric potential isosurface, comprising:

S531: extracting coordinates and electric potential values of a cuboid unit and its vertices in the three-dimensional electric potential imaging volume, wherein length $r_1$, width $r_2$, and height $r_3$ of the cuboid unit meet the following condition:

$$\begin{cases} r_1 r_2 r_3 = \frac{1}{\lambda} = \frac{(x_2 - x_1)(y_2 - y_1)(z_2 - z_1)}{m_1 m_2 m_3} \\ r_1 = \frac{x_2 - x_1}{m_1} \\ r_2 = \frac{y_2 - y_1}{m_2} \\ r_3 = \frac{z_2 - z_1}{m} \end{cases} \quad m_1, m_2, m_3 = 1, 2, 3, \ldots, 100$$

where, $m_1$, $m_2$, $m_3$ are scale factors in length, width, and height directions of the cuboid unit respectively, and wherein λ is the interpolation density;

S532: comparing the electric potential value $U_q$(q=1~8) of each vertex of the cuboid unit with the electric potential value V of the isosurface; wherein, if $U_q$<V, then an index value $I_q$ of the vertex is set to 0; and wherein, if $U_q$≥V, then the index value $I_q$ of the vertex is set to 1;

S533: using a central difference theory to calculate gradient values of various vertices of the cuboid unit, and then determining their normal vector values $\overrightarrow{V(G_{xyz})}$, wherein a calculation formula for gradient values of a vertex G of the cuboid unit is:

$$\begin{cases} Grad(x_i) = \frac{V(G_{x_i+r_1}) - V(G_{x_i-r_1})}{2r_1} \\ Grad(y_i) = \frac{V(G_{y_i+r_2}) - V(G_{y_i-r_2})}{2r_2} \\ Grad(z_i) = \frac{V(G_{z_i+r_3}) - V(G_{z_i-r_3})}{2r_3} \end{cases}$$

where, $V(G_{x_i+r_1})$ and $V(G_{x_i-r_1})$ are respectively the electric potential values of vertex G at adjacent interpolation points on an x-axis, and $V(G_{y_i+r_2})$ and $V(G_{y_i-r_2})$ are respectively the electric potential values of vertex G at adjacent interpolation points on a y-axis, $V(G_{z_i+r_3})$ and $V(G_{z_i-r_3})$ are respectively the electric potential values of vertex G at adjacent interpolation points on a z-axis, and the normal vector value $\overrightarrow{V(G_{xyz})}$ at the vertex G is a vector sum of $Grad(x_i)$, $Grad(y_i)$ and $Grad(z_i)$;

S534: using a linear interpolation method to process the normal vectors of the vertices of the cuboid unit to calculate the normal vectors of the intersection points of the edges of the cuboid unit intersecting with the isosurface, and determining a spatial shape of the electric potential isosurface according to the coordinates and the normal vectors of the intersection points of the edges of the cuboid unit intersecting with the isosurface.

5. The method of claim 1, wherein the step S6 comprises S61-65, comprising:

performing unilateral inversion tomogram imaging outside a borehole area through the electric potential measurement points on the electric potential measurement line at the highest position, to obtain an electric potential inversion plane nephogram, which divides a digital space outside the boreholes into several cuboid spaces, using a radial basis function surface interpolation method to perform interpolation on an interior of a cuboid grid, and obtaining a three-dimensional isosurface model of electric potential inversion probability value by splicing and merging, wherein the specific steps of S61-65 are as follows:

S61: performing unilateral inversion tomogram imaging outside the borehole area through the electric potential measurement points on the electric potential measurement line at the highest position, to obtain electric potential inversion probability values of various points on the electric potential inversion plane nephogram, which represents a probability of abnormal electric potentials, with a value range between 0 and 1, wherein the larger the value is, the higher a degree of danger is; dividing an outer ring space of the borehole into several cuboid grids through the electric potential inversion plane nephogram, selecting a cuboid grid, and selecting a total of m scattered points with the same electric potential inversion probability value η from 6 facets of the cuboid grid, wherein the electric potential inversion probability value is $T_i$, $T_i=\eta$, and its coordinate vector is $R_r=(x_r, y_r, z_r)$;

S62: constructing a matrix vector $T=(T_1, T_2, T_3, \ldots, T_m, 0, 0, 0, 0)$ of each of the electric potential inversion probability values and a Gaussian radial basis function $u(R-R_r)$ expressed as:

$$u(R-R_r)=e^{\left(-\frac{\|R-R_r\|^2}{2\sigma_r^2}\right)} \quad r=1, 2, 3, \ldots, m$$

where, $$\sigma_r=\frac{\mathrm{Max}\|R_i-R_j\|}{\sqrt{2m}},$$

i, j=1,2,3, . . . , m, R=(x, y, z) is a coordinate vector of an interpolation point inside the cuboid grid, $R_i=(x_i, y_i, z_i)$, $R_j=(x_j, y_j, z_j)$ are respectively coordinate vectors of points i and j on the facets of the cuboid grid, and $\mathrm{Max}\|R_i-R_j\|$ is the farthest distance between scattered points;

S63: obtaining an unknown parameter vector E by solving the following matrix formula using a least square method:

$$U \cdot E = T$$

wherein, vector $E=(e_1, e_2, e3, \ldots, e_m, c_0, c_1, c_2, c_3)$, $e_i$ is an unknown parameter and $c_0$, $c_1$, $c_2$ and $c_3$ are constants, $$U=\begin{bmatrix} u_{11} & u_{12} & \ldots & u_{1m} & 1 & x_1 & y_1 & z_1 \\ u_{21} & u_{22} & \ldots & u_{2m} & 1 & x_2 & y_2 & z_2 \\ \vdots & \vdots & \vdots & \vdots & \vdots & \vdots & \vdots & \vdots \\ u_{m1} & u_{m2} & \ldots & u_{mm} & 1 & x_m & y_m & z_m \\ 1 & 1 & \ldots & 1 & 1 & x_m & y_m & z_m \\ x_1 & x_2 & \ldots & x_m & 0 & 0 & 0 & 0 \\ y_1 & y_2 & \ldots & y_m & 0 & 0 & 0 & 0 \\ z_1 & z_2 & \ldots & z_m & 0 & 0 & 0 & 0 \end{bmatrix},$$

$$u_{ij}=u(\|R_i-R_j\|), \text{ and } i, j=1, 2, 3, \ldots, m;$$

S64: substituting $e_i$ from the solved unknown parameter vector E into the following formula to calculate the coordinate vector R=(x, y, z) of all interpolation points inside the cuboid grid, wherein:

$$T(R)=\sum_{i=1}^{m} e_i u(\|R-R_i\|)+c_0+c_1x+c_2y+c_3z$$

and wherein T(R) is the electric potential inversion probability value at the interpolation point on the isosurface;

S65: obtaining the isosurface in each cuboid grid by connecting the isosurfaces inside all cuboid grids according to a shared relationship between facets and edges, to obtain the three-dimensional isosurface model of the electric potential inversion probability value.

* * * * *